United States Patent [19]

Anderson

[11] 4,419,059

[45] Dec. 6, 1983

[54] NONSYMMETRIC BORE CONTOUR FOR ROTARY COMPRESSOR

[75] Inventor: Vincent P. Anderson, Knight Township, Vanderburgh County, Ind.

[73] Assignee: Whirlpool Corporation, Benton Harbor, Mich.

[21] Appl. No.: 291,791

[22] Filed: Aug. 10, 1981

[51] Int. Cl.[3] ..... F04C 18/00

[52] U.S. Cl. ..... 418/150; 418/255

[58] Field of Search ..... 418/150, 255

[56] References Cited

U.S. PATENT DOCUMENTS

| | | | |
|---|---|---|---|
| 986,502 | 3/1911 | Roessler | 418/255 X |
| 2,278,740 | 4/1942 | Roessler | 418/150 |
| 2,347,944 | 5/1944 | Fowler | 418/150 |
| 3,499,600 | 3/1970 | McGregor | 418/150 X |
| 3,642,390 | 2/1972 | Ostberg | 418/150 X |
| 3,890,071 | 6/1975 | O'Brien | 418/150 X |
| 4,133,617 | 1/1979 | Reynaud | 418/150 |

FOREIGN PATENT DOCUMENTS

| | | | |
|---|---|---|---|
| 49-3530 | 1/1974 | Japan | 418/150 |

*Primary Examiner*—Leonard E. Smith

*Attorney, Agent, or Firm*—Wood, Dalton, Phillips, Mason & Rowe

[57] ABSTRACT

A rotary compressor having a blade slidably carried in a slot in a rotor within the compression cylinder. The opposite ends of the blade are in contact with the cylinder walls at all times, notwithstanding the nonsymmetrical configuration of the cylinder bore. The nonsymmetrical configuration arises from the addition of a cycloidal cam function to the bore equation in the first quadrant and the subtraction thereof from the bore equation in the third quadrant. The cylinder contour resulting from the provision of the cycloidal cam function provides increased operating efficiency in the rotary compressor and allows the length of the transfer slot thereof to be reduced or eliminated so as to reduce recompression volume of the compressor.

11 Claims, 6 Drawing Figures

FIG. 1
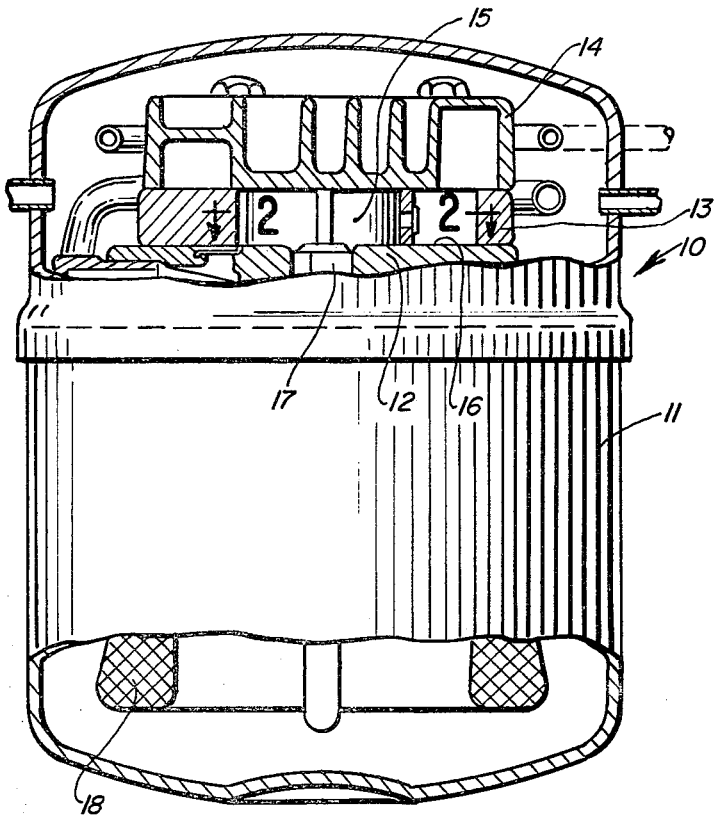
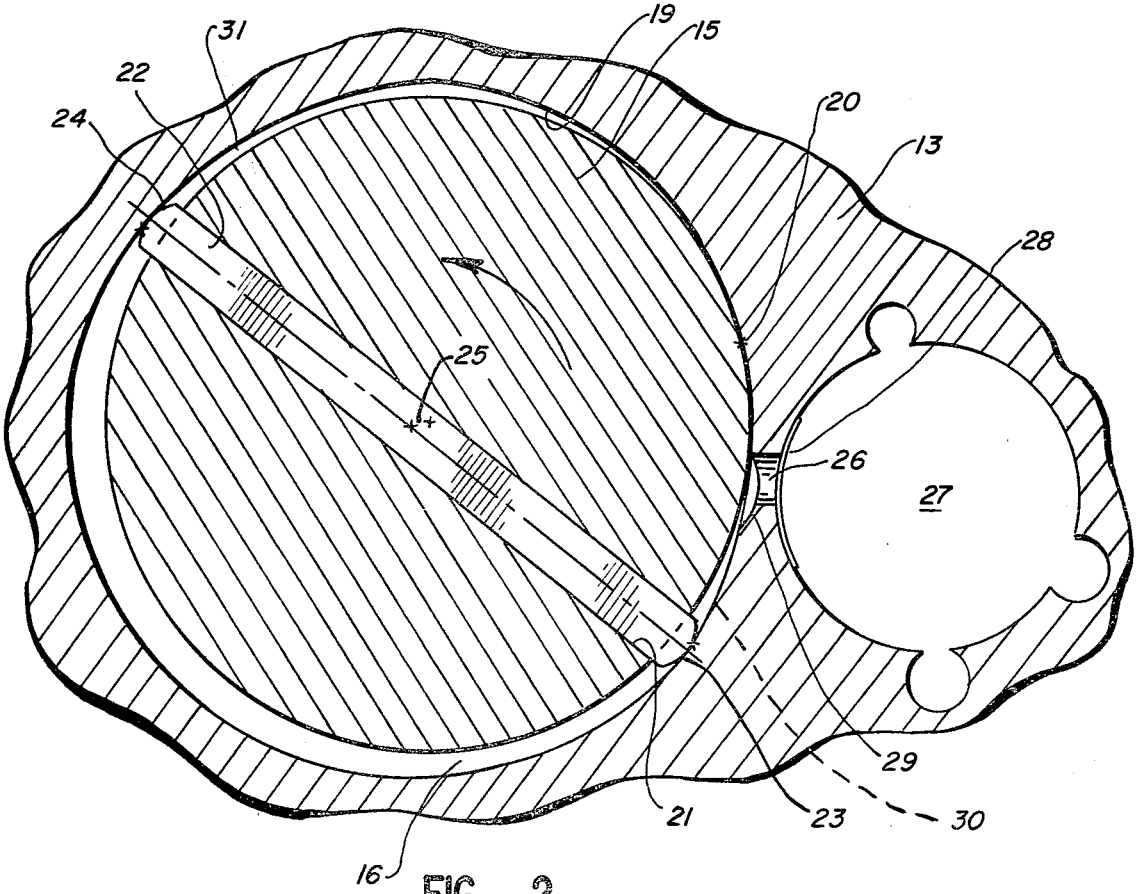
FIG. 2

FIG. 5
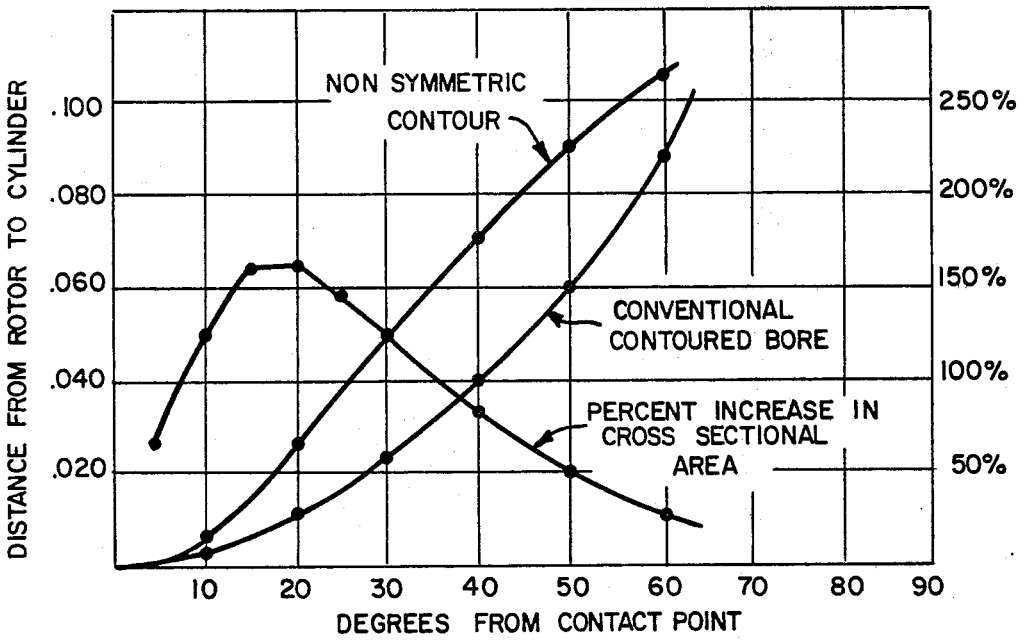
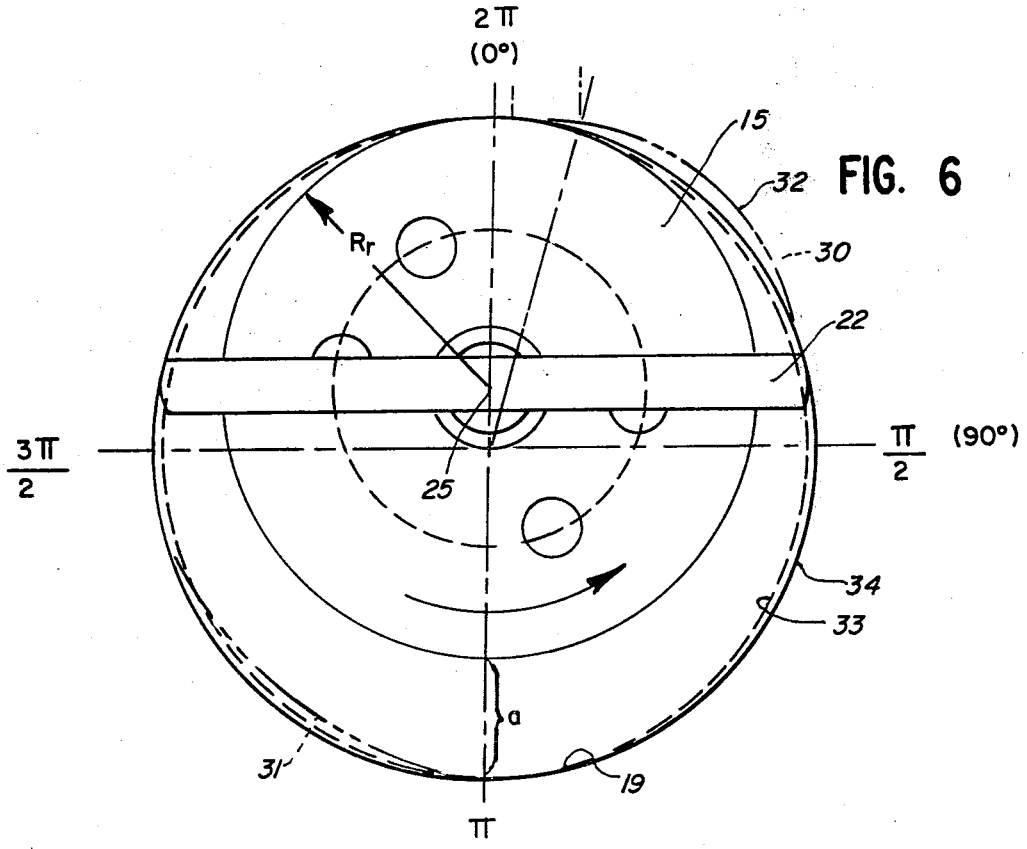
FIG. 6

NONSYMMETRIC BORE CONTOUR FOR ROTARY COMPRESSOR

BACKGROUND OF THE INVENTION

1. Field of the Invention

This invention relates to rotary compressors, and in particular to bore contours for the compression cylinder of rotary compressors.

2. Description of the Background Art

In U.S. Pat. No. 3,499,600, of Ralph McGregor, which patent is owned by the assignee hereof, a rotary compressor is disclosed having a single blade construction including a unique configuration for the blade tips and a unique contour for the chamber wall of the compression cylinder. The contour cylinder bore provides an increase in the cross-sectional area of the chamber as compared to a round cylindrical chamber, with the maximum increase occurring at points spaced 90° and 270° from the point where the rotor is most closely juxtaposed to the cylinder wall. More specifically, the cross-sectional area of the chamber adjacent the transfer slot is greater than that of a round cylinder, permitting the discharge region of the compressor to be configured for minimizing re-expansion of compressed gas in the outlet, thereby causing the discharge pressure to more closely approximate the highest pressure within the compression chamber.

A number of other prior art compression chamber configurations have been developed for use in rotary compressors. Illustratively, Amandus C. Roessler shows, in U.S. Pat. No. 986,502, a rotary compressor having a nonsymmetrical bore that is opened up in the throat area. As shown in the drawing, the contour differs from a cylindrical contour in two adjacent quandrants.

In a second U.S. patent of Amandus C. Roessler, No. 2,278,740, a rotary pump is disclosed which again enlarges the cylinder contour in two adjacent quadrants preceding the discharge port.

In U.S. Pat. No. 3,642,390 of Bernard N. Ostberg, a compressor is shown having a symmetrical contour about a line drawn through the contact point and center of the rotor, with the contour being enlarged in the quadrant containing the discharge port and the quadrant containing the suction inlet.

Another compressor is illustrated in U.S. Pat. No. 4,133,617 of Denis A. L. M. Reynaud. The compressor thereof is provided with a cylinder configuration having a noncircular, symmetrical bore contour.

A two-blade compressor having a symmetrical bore contour is disclosed in U.S. Pat. No. 2,347,944 of Elbert Fowler. As shown therein, the bore contour is defined by two opposite concentric arcs of unequal radii which are joined by a noncircular curved portion defined by a specified formula.

In Japanese Utility Model Application No. 3530-1974, another symmetrical cylinder configuration is disclosed, wherein a cycloidal cam function is applied over the first and second quadrants of the bore. The configuration appears to be symmetrical about an axis defined by the rotor contact point and the rotor center.

SUMMARY OF THE INVENTION

The present invention comprehends an improved structure for a single blade, through-slot rotary compressor, wherein the compression chamber wall is defined by a curve determined by a formula similar to that disclosed in McGregor U.S. Pat. No. 3,499,600, but modified to include a cycloidal cam function which is added in the first quadrant and subtracted in the third quadrant. The resulting cylinder wall contour is asymmetrical about the axis defined by the point of contact of the rotor with the cylinder wall and the center of the rotor, and yet the contour obeys a set of design considerations that are highly desirable for single blade compressors.

The cycloidal cam function applied to the compressor cylinder contour effctively comprises a combination of a ramp function and sine function.

The improved contour provides a substantial increase in the cross sectional area of the compression chamber in the throat region of the compressor, as compared to a conventional round bore or the cylinder contour disclosed in the McGregor U.S. Pat. No. 3,499,600. As a result of the use of the improved cylinder contour, the transfer slot may be moved back toward the contact point, or eliminated, so as to substantially increase the operating efficiency of the compressor.

The use of the improved contour and relocated transfer slot has provided an improvement of from 2% to 6% in the compressor operating performance, as compared to the McGregor contour. This provides a substantial improvement in the energy efficiency of various compressor applications, such as refrigeration applications and the like.

In broad aspect, the invention comprehends the provision of an improved single blade rotary compressor bore contour wherein a cycloidal cam function is added to the contour in the first quadrant and subtracted from the contour in the third quadrant so as to provide an asymmetrical bore configuration that provides a substantial increase in the cross sectional are of the compression chamber in the throat area.

BRIEF DESCRIPTION OF THE DRAWING

Other features and advantages of the invention will be apparent from the following description taken in connection with the accompanying drawings wherein:

FIG. 1 is an elevation of a rotary compressor having a compression cylinder provided with a bore contour embodying the invention;

FIG. 2 is a fragmentary enlarged horizontal section taken substantially along the line 2—2 of FIG. 1 and illustrating in greater detail the improved cylinder bore configuration embodying the invention;

FIG. 5 is a graph showing the percentage increase in cross-sectional area provided by the improved nonsymmetric contour of the invention; and FIG. 6 is a horizontal section illustrating the differences between the conventional round bore, the contoured bore of the McGregor patent, and the improved asymmetrical bore of the present invention.

DESCRIPTION OF THE PREFERRED EMBODIMENT

Figure 3:
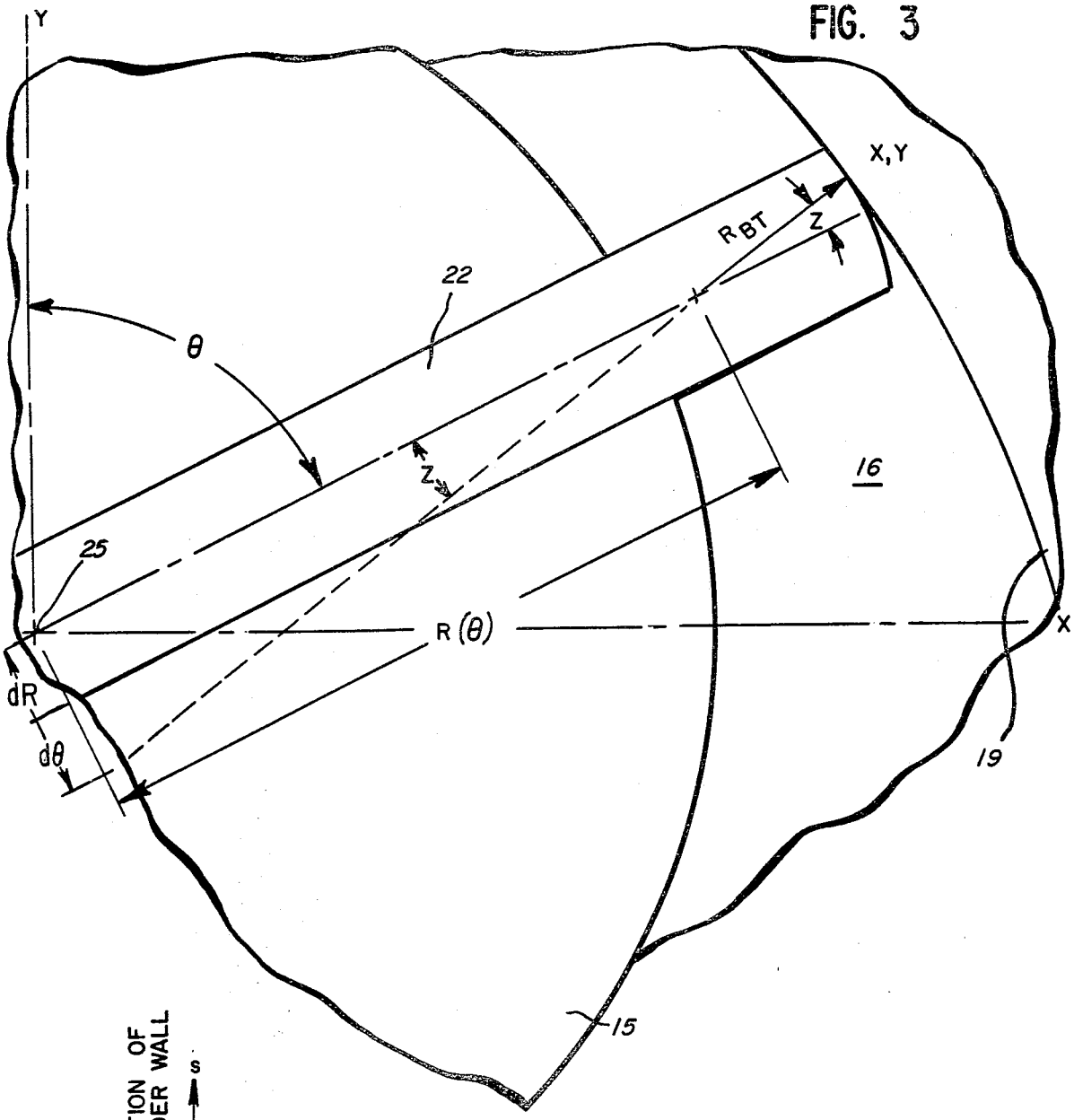
FIG. 3 is a further enlarged sectional view identifying a number of the parameters of the bore configuration formulae.

In the illustrative embodiment of the invention as disclosed in the drawings, a compressor generally designated 10 is shown to comprise a rotary compressor generally similar to that disclosed in the McGregor U.S. Pat. No. 3,499,600. The compressor includes an outer housing 11, a front head 12, a compression cylinder 13, and a rear head 14. A cylindrical rotor 15 is disposed in the compression chamber 16 of cylinder 13 and is rotated by means of a shaft 17 driven by an electric motor 18 within the housing 11.

Referring now to FIG. 2, the compression chamber 16 within cylinder 13 is defined by a peripheral, generally cylindrical wall 19. Rotor 15 comprises a right circularly cylindrical rotor having a point of contact 20 with the cylinder wall 19. The rotor defines a diametric slot 21 in which is slidably received a blade 22 having opposite tips 23 and 24 slidably engaging the wall 19 in all rotary positions of the rotor.

As can be understood with reference to FIG. 2, as the rotor 15 rotates about its axis 25, the blade 22 reciprocates longitudinally in the slot 21 with one end of the blade being fully received in the slot at the contact point 20 and the opposite end of the blade projecting to a maximum extent from the rotor at that rotational position of the rotor.

As further illustrated in FIG. 2, cylinder 13 is provided with a discharge passage 26 opening to a discharge chamber 27 provided with a suitable leaf valve 28. Valve 28 may be of the type disclosed in U.S. Pat. No. 4,199,309 of Ralph F. Connor and assigned to the assignee of the present invention. Passage 26 opens inwardly to cylinder chamber 16 through an undercut transfer slot 29 extending radially outwardly from the chamber 16.

The present invention comprehends a modification of the generally cylindrical configuration of wall 19, which may have a configuration generally similar to that of the McGregor patent, by opening up the throat area 30 radially outwardly in the vicinity of the transfer slot 29, and providing a reverse closing up of the contour at the opposite position of the wall as at 31, as seen in FIG. 2. More specifically, in the illustrated embodiment, the contour of the cylinder wall 19 is defined by a curve having coordinates:

$$X=R(\theta)\sin\theta+R_{bt}\sin(\theta-Z)$$

and $$Y=R(\theta)\cos\theta+R_{bt}\cos(\theta-Z)$$

where the Y axis passes through the contact point and the center of the rotor, the X axis passes through the center of the rotor and is perpendicular to the Y axis, $\theta$ is the angle between the Y axis and the centerline of the blade, Z is the angle between point of contact of the blade with the chamber wall and the longitudinal centerline of the blade with its vertex at the center of curvature of the blade tip, $R_{bt}$ is the radius of the blade tip, and where $R(\theta)$ is the distance from the center of the rotor to the center of the blade tip radius $R_{bt}$. As can be understood with reference to FIG. 3, $$Z=\tan^{-1}\left[\frac{dR/d\theta}{R(\theta)}\right].$$

According to the present invention, $R(\theta)$ is determined by the formulae:

for $0\leqq\theta\leqq\pi/4$ radians $$R(\theta)=R_0+R_1\cos(\theta)+G\left[\frac{4\theta}{\pi}-\frac{1}{2\pi}\sin(8\theta)\right]$$

for $\pi/4\leqq\theta\leqq\pi/2$ $$R(\theta)=R_0+R_1\cos(\theta)+G\left[1-\frac{4(\theta-\pi/4)}{\pi}+\frac{1}{2\pi}\sin(8\theta)\right]$$

for $\pi/2\leqq\theta\leqq\pi$ $$R(\theta)=R_0+R_1\cos(\theta).$$

for $\pi\leqq\theta\leqq5\pi/4$ $$R(\theta)=R_0+R_1\cos(\theta)+G\left[\frac{-4(\theta-\pi)}{\pi}+\frac{1}{2\pi}\sin(8\theta)\right]$$

for $5\pi/4\leqq\theta\leqq3\pi/2$ $$R(\theta)=R_0+R_1\cos(\theta)+G\left[-1+\frac{4(\theta-5\pi/4)}{\pi}-\frac{1}{2\pi}\sin(8\theta)\right]$$

for $3\pi/2\leqq\theta\leqq2\pi$ $$R(\theta)=R_0+R_1\cos(\theta)$$

where $$R_0=R_r+\frac{a}{2}-R_{bt},\ R_1=-\frac{a}{2},$$

and G=any selected increase in rotor to cylinder distance at $\theta=\pi/4$ which maintains $R(\theta)$ as a monotone increasing function of $\theta$ for $0\leqq\theta\leqq\pi$ and a monotone decreasing function of $\theta$ for $\pi\leqq\theta\leqq2\pi$.

With reference to FIG. 3, it can be seen that $R(\theta)$ defines the locus of points defined by the center of the blade tip radius as the blade 22 rotates within compression chamber 16. The actual configuration of the cylinder wall 19 is then defined by the preceding formulae for X and Y, using the valves determined for $R(\theta)$.

The contour of wall 19 thus defined is asymmetrical relative to a line drawn through the contact point 20 and the rotor axis 25, being enlarged in the first quadrant by a cycloidal cam function and decreased in the third quadrant by a corresponding cycloidal cam function.

The contour provided by the formula of the present invention assures that each of the following design considerations for single blade rotary compressors obtain:

(a) $R(\theta)+R(\theta+\pi)$=constant (single blade, both ends contact cylinder wall)

(b) $R(0°)=R_r-R_{bt}$ (c) $R(\theta)$, $dR/d\theta$, and $d^2R/d\theta^2$ are each continuous for $0\leqq\theta\leqq2\pi$ (d) $R(\theta)\geqq R_r-R_{bt}$ for all $\theta$ (blade fills slot).

These design considerations must be met if a compressor is to operate with maximum efficiency and reliability, while producing a minimum amount of blade noise.

Figure 4:
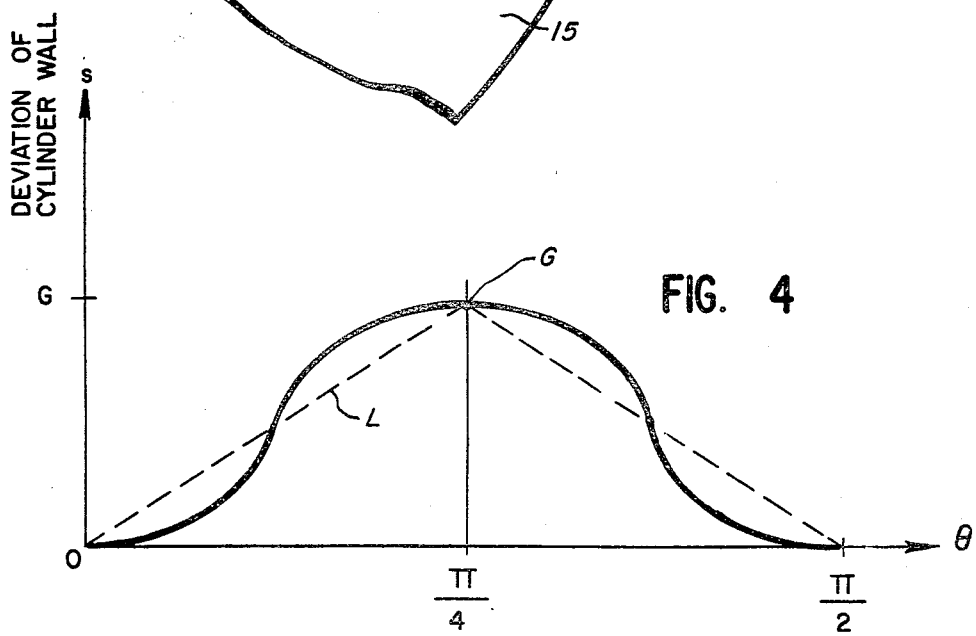
FIG. 4 is a graph illustrating the manner in which the cycloidal cam function modifies the cylinder bore contour.

In the illustrated embodiment, as seen in FIG. 4, the maximum deviation of the cylinder wall from the McGregor patent contour is provided at $\pi/4$ at 45° from contact point 20 relative to the rotor axis 25. As can be appreciated from this figure, the cycloidal cam function provides a gradual increase and decrease in the blade velocity and acceleration as compared to the levels of velocity and acceleration provided by the McGregor contour. As shown, the cycloidal cam function characteristic provides a substantial improvement over a contour based on a simple function L which increases linearly to the 45° point and then decreases linearly, as the blade acceleration would be very high resulting from the sudden change in the slope characteristics.

As illustrated in FIG. 4, the maximum deviation produced by the cycloidal cam function is the constant G which may be selected as desired, as indicated above, as long as $R(\theta)$ is a monotone increasing function of $\theta$ for angles up to $\pi$ and a monotone decreasing function of $\theta$ for angles between $\pi$ and $2\pi$.

The manner in which the nonsymmetric contour of the present invention differs from a conventional round compressor bore and the McGregor bore contour can be seen with reference to FIG. 6, in which the nonsymmetric contour is shown by the broken line 32, the round bore by dashed line 33, and the McGregor contour by the solid line 34.

In one illustrative embodiment of the invention, G may have a value of 0.0370 for use in a 720 BTUH compressor having a bore size of 1.690" and a throat angle of 18.5°.

Referring to the graph of FIG. 5, the improved nonsymmetric contour provided by the present invention provides a very substantial increase in the cross-sectional area over that provided by the conventional contoured bore of the McGregor structure and, thus, the present invention provides a further improvement over a conventional round bore, over which the McGregor contour provides an increased cross-sectional area.

As indicated above, the improved contour is asymmetrical about all axes of the compression chamber while yet meeting a set of important design considerations for providing high efficiency in rotary compressor functioning. The use of the new contour enables the transfer slot conventionally provided in such rotary compressors to be either eliminated or relocated substantially toward the rotor contact point, thereby reducing the recompression volume and substantially improving the efficiency of the compressor.

While the compressor bore contour described herein has particular benefit when employed in a single blade, through-slot rotary compressor, it will be appreciated by those skilled in the art that the improved bore contour can also be used to advantage in rotary compressors having two diametrically opposed blades.

The foregoing disclosure of specific embodiments is illustrative of the broad inventive concepts comprehended by the invention.

Having described the invention, the embodiments of the invention in which an exclusive property or privilege is claimed are defined as follows:

1. In a rotary compressor having a wall defining a compression chamber having a discharge opening, a cylindrical rotor eccentrically positioned in said chamber and defining a center and a diametric slot, said rotor engaging the chamber wall at a point of contact adjacent the outlet passage, an onepiece blade longitudinally reciprocably slidably received in said slot and having opposite projecting tips each having a center of curvature on the longitudinal centerline of the blade and being in sliding contact with the chamber wall for substantially all rotational positions of the rotor, said wall having a contour generally defined by the formula $R(\theta)=R_0+R_1\cos(\theta)$, where $R(\theta)$ is the distance from the center of the rotor to the center of the blade tip radius, $R_0$ is the radius of the rotor minus the blade tip radius plus one-half the distance ("a") between the rotor and the chamber wall at the point opposite the contact point, and $$R_1 = -\frac{a}{2},$$

and wherein the wall is further defined by a radially outward enlargement of said contour in the quadrant of the chamber containing said discharge opening and radially inward reduction of said contour in the opposite quadrant of the chamber.

2. The rotary compressor structure of claim 1 wherein said curve is enlarged by the addition of a cycloidal cam function in said quadrant containing said discharge opening.

3. The rotary compressor structure of claim 1 wherein said curve is enlarged by the addition of a cycloidal cam function in said quadrant containing said discharge opening and is reduced by the subtraction of said cycloidal cam function in said opposite quadrant.

4. In a rotary compressor having a wall defining a compression changer having a discharge opening, a cylindrical rotor eccentrically positioned in said chamber and defining a center and a diametric slot, said rotor engaging the chamber wall at a point of contact generally adjacent the discharge opening, a one-piece blade longitudinally reciprocably slidably received in said slot and having opposite projecting tips each having a center of curvature on the longitudinal centerline of the blade and being in sliding contact with the chamber wall for substantially all rotational positions of the rotor, said wall having a contour defined by a curve having coordinates $$X=R(\theta)\sin\theta+R_{bt}\sin(\theta-Z)$$

and $$Y=R(\theta)\cos\theta+R_{bt}\cos(\theta-Z),$$

where the Y axis passes through the point of contact between the rotor and chamber wall and the center of the rotor and the X axis passes through the center of the rotor perpendicularly to the Y axis, $\theta$ is the angle between the Y axis and the centerline of the blade, Z is the angle between point (X, Y) of contact of the blade with the chamber wall and the longitudinal centerline of the blade with its vertex at the center of curvature of the blade tip, $R_{bt}$ is the radius of the blade tip, $$Z = \tan - \frac{dR/d\theta}{R(\theta)},$$

and where $R(\theta)$ is the distance from the center of the rotor to the center of the blade tip radius $R_{bt}$ and is determined by the formulae:

for $0 \leqq \theta \leqq \pi/4$ radians $$R(\theta) = R_0 + R_1 \cos(\theta) + G\left[\frac{4\theta}{\pi} - \frac{1}{2\pi}\sin(8\theta)\right]$$

for $\pi/4 \leqq \theta \leqq \pi/2$ $$R(\theta) = R_0 + R_1 \cos(\theta) + G\left[1 - \frac{4(\theta - \pi/4)}{\pi} + \frac{1}{2\pi}\sin(8\theta)\right]$$

for $\pi/2 \leqq \theta \leqq \pi$ $$R(\theta) = R_0 + R_1 \cos(\theta)$$

for $\pi \leqq \theta \leqq 5\pi/4$ $$R(\theta) = R_0 + R_1 \cos(\theta) + G\left[\frac{-4(\theta - \pi)}{\pi} + \frac{1}{2\pi}\sin(8\theta)\right]$$

for $5\pi/4 \leqq \theta \leqq 3\pi/2$ $$R(\theta) = R_0 + R_1 \cos(\theta) + G\left[-1 + \frac{4(\theta - 5\pi/4)}{\pi} - \frac{1}{2\pi}\sin(8\theta)\right]$$

for $3\pi/2 \leqq \theta \leqq 2\pi$ $$R(\theta) = R_0 + R_1 \cos(\theta)$$

where $$R_0 = R_r + \frac{a}{2} - R_{bt},$$

$R_r$=the radius of the rotor, a=the distance from the rotor to the chamber wall at the point opposite the contact point, $$R_1 = -\frac{a}{2},$$

and G=any selected increase in rotor to chamber wall distance at $\theta = \pi/4$ which maintains $R(\theta)$ as a monotone increasing function of $\theta$ for $0 \leqq \theta \leqq \pi$ and a monotone decreasing function of $\theta$ for $\pi \leqq \theta \leqq 2\pi$.

5. The rotary compressor structure of claim 4 wherein $R(\theta)+R(\theta+\pi)$ is a constant.

6. The rotary compressor structure of claim 4 wherein $R(0°)$=the rotor radius$-R_{bt}$.

7. The rotary compressor structure of claim 4 wherein $R(\theta)$ is continuous for $0 \leqq \theta \leqq 2\pi$.

8. The rotary compressor structure of claim 4 wherein $dR(\theta)/d\theta$ is continuous for $0 \leqq \theta \leqq 2\pi$.

9. The rotary compressor structure of claim 4 wherein $d^2R(\theta)/d\theta^2$ is continuous for $0 \leqq \theta \leqq 2\pi$.

10. The rotary compressor structure of claim 4 wherein $R(\theta) \geqq$ the rotor radius$-R_{bt}$ for all $\theta$.

11. The rotary compressor structure of claim 4 wherein $R(\theta) \neq R(-\theta)$ at at least some angle $\theta$.

* * * * *